United States Patent [19]

Sahler et al.

[11] Patent Number: 4,610,096

[45] Date of Patent: Sep. 9, 1986

[54] TRANSFORMABLE STENCIL TOY

[75] Inventors: John T. Sahler, Bethlehem; Marianne G. Laubach, Easton, both of Pa.

[73] Assignee: Binney & Smith, Inc., Easton, Pa.

[21] Appl. No.: 647,106

[22] Filed: Sep. 4, 1984

[51] Int. Cl.[4] ..... B44D 3/30

[52] U.S. Cl. ..... 33/565; 33/562; 33/564

[58] Field of Search ..... 33/565, 566, 562, 564

[56] References Cited

U.S. PATENT DOCUMENTS

| | | | |
|---|---|---|---|
| 1,974,442 | 9/1934 | Baldwin | 33/565 |
| 3,007,247 | 11/1961 | Boehm | 33/565 |
| 4,251,920 | 2/1981 | Cassagnes | 33/565 |
| 4,563,154 | 1/1986 | Vandervort et al. | 33/565 |

FOREIGN PATENT DOCUMENTS

| | | | |
|---|---|---|---|
| 883508 | 6/1953 | Fed. Rep. of Germany | 33/565 |

*Primary Examiner*—Willis Little

*Attorney, Agent, or Firm*—Neuman, Williams, Anderson & Olson

[57] ABSTRACT

A transformable stencil toy is provided which includes a main body plate, a sliding plate in limited slidable engagement with the main body plate, and one or more pivoting plates in limited pivotal engagement with the sliding plate and in limited slidable engagement with the main body plate. When the sliding plate moves to the first limit of its slidable engagement with respect to the main body portion, the pivoting plates move to a first predetermined position and the stencil toy assumes the configuration of a first traceable object. When the sliding plate moves to the second limit of its slidable engagement, the pivoting plates move to a second predetermined position and the stencil toy assumes the configuration of a second traceable object.

12 Claims, 11 Drawing Figures

TRANSFORMABLE STENCIL TOY

BACKGROUND OF THE INVENTION

1. Field of the Invention

The present invention generally relates to articles for the playtime use of a child and more specifically to a transformable stencil toy which assumes different configurations and provides a variety of perforation arrangements.

2. Background of the Invention

One may characterize articles for the playtime use of children, i.e., toys, either as non-representational or as representational. Non-representational toys include items such as balls, tops, jump ropes, or the like which are designed and intended to encourage manual and muscular dexterity and group integration since a child can use them individually or with other children.

Representational toys include those toys which create a mental image of something previously perceived or of something never before wholly perceived in reality. These items usually represent people, creatures, or implements, and they are designed and intended to stimulate imagination, mimetic activity or manipulative skill.

One type of representational toy is a cutout. This toy is a simple outline or silhouette-type figure or design usually cut out of a flat sheet of paper, metal, plastic or fabric. Its amusement or diversion value, however, is minimal, except to the very young. Save looking at its outline, tracing this outline on another surface with ink or paint, or maybe using it as a pattern to cut out another identical figure, a child cannot manipulate a cutout to create different images which he or she had previously perceived or to form mental images of something never before wholly perceived.

Another type of representational toy is a stencil. This toy is usually a flat rectangular plate made of metal or plastic material and perforated with lettering or designs through which one can apply a substance such as ink or paint to another surface. However, its amusement or diversion value is also minimal, since a child using it can only form the preconceived designs of the stencil's manufacturer.

In addition to the drawbacks discussed above, cutouts and stencils, as well as other toys, do not provide mystery and excitement for children because the amusement possibilities that they offer are apparent upon a casual inspection of them. They do not stimulate imagination or manipulative skill to the fullest extent possible.

Thus, it is a general object of the present invention to provide a toy which is easy and safe to use, inexpensive to manufacture, and one which greatly stimulates a child's imagination and manipulative skills.

It is a further object of the present invention to provide a transformable stencil toy with movable and perforated sections that a child may arrange and rearrange with simple and fluid motions to create a variety of images. More specifically, it is an object of the present invention to provide a transformable stencil with movable portions that a child may arrange and rearrange to change the periphery of the stencil from one design to another and the location of the perforations on the stencil portions to create a wide variety of shapes and images that a child can trace or draw on a working surface such as canvas or paper.

SUMMARY OF THE INVENTION

The foregoing objects and advantages of the present invention are achieved through the provision of a transformable stencil toy made of an assembly of perforated plates connected so that when the user slides one of the plates to one position the stencil toy assumes a certain configuration and when he or she slides it to another position the toy assumes a second configuration. The shape of each plate and the perforations on the plates help provide the identity of the toy in each configuration and they form a template with movable perforations which the user may use to draw, trace or otherwise create various images on a paper or canvas surface. Thus, the stencil toy is essentially a two dimensional, transformational template.

The stencil toy of the present invention has a main body plate, a sliding plate in limited slidable engagement with the main body plate, and one or more pivoting plates in limited pivotal engagement with the sliding plate and in limited slidable engagement with the main body plate. When the sliding plate moves to the first limit of its slidable engagement with respect to the main body portion, the pivoting plates move to a first predetermined position and the stencil toy assumes the configuration of a first traceable object. When the sliding plate moves to the second limit of its slidable engagement, the pivoting plates move to a second predetermined position and the stencil toy assumes the configuration of a second traceable object.

With this stencil toy, a child can trace or draw a variety of images and transform the toy from one shape to another. The toy provides an appreciable amount of amusement and diversion for children and it stimulates their imagination and manipulative skills.

DESCRIPTION OF THE DRAWINGS

For a more complete understanding of this invention one should now refer to the embodiments illustrated in greater detail in the accompanying drawings and described below as examples of the invention. In the drawings.

It should be understood that the drawings are not necessarily to scale and that the embodiments are sometimes illustrated by graphic symbols, phantom lines, diagrammatic representations and fragmentary views. In certain instances, details which are not necessarily for the understanding of the present invention or which render other details difficult to perceive may have been omitted.

While the invention will be described in connection with three preferred embodiments, it will be understood that the invention is not limited to these embodiments but rather covers all alternatives, modifications and equivalents as may be within the spirit and scope of the invention as defined by the appended claims.

DETAILED DESCRIPTION OF THE DRAWINGS AND THE PREFERRED EMBODIMENTS

Turning now to the drawings, FIGS. 1–4 and 9–10A show the first preferred embodiment of the manipulatable stencil toy of the present invention at 11. The stencil toy generally comprises a body plate 13, a sliding plate 15, and two pivoting wing plates 17*a* and 17*b*. All four plates, 13, 15, 17*a* and 17*b*, have perforations of various forms and sizes. The plates may be plastic, metal or any other suitable material. Together these four plates form, essentially, a two dimensional transformational toy which a user can transform from one configuration to another completely different configuration in one smooth, fluid motion. The shape of each plate and the perforations on the plates help create the identity of the toy in a particular arrangement, and they make the toy a template with movable perforations which the user may use to draw, trace or otherwise create various images on a paper or canvas surface. (See FIG. 1).

Figure 3:
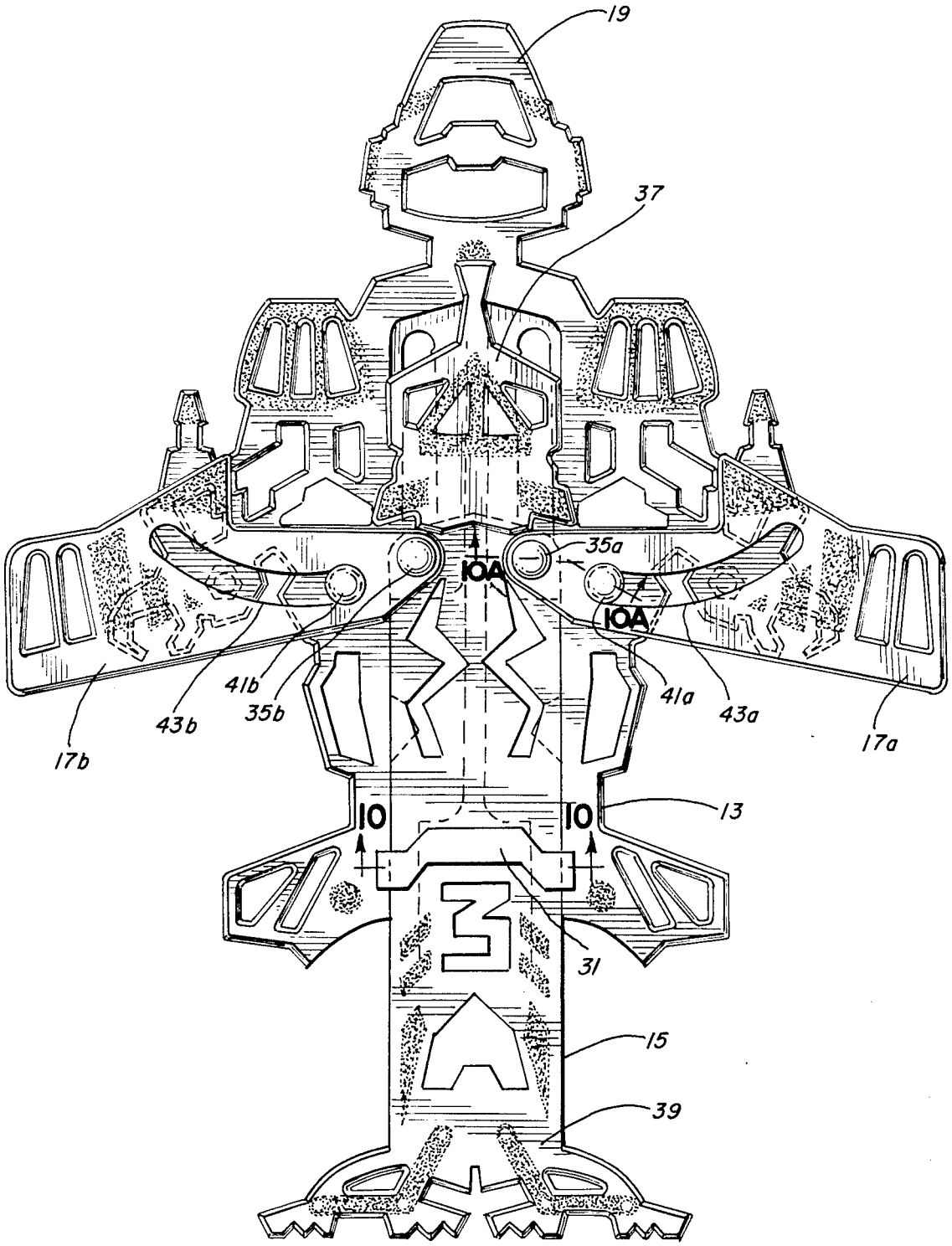
FIG. 3 is a plan view of the first embodiment of the transformable stencil toy showing the toy in an extended position in which it gives the general appearance of a military airplane.

The first configuration of the first embodiment as shown in FIG. 3 is that on an airplane with the body plate 13 serving as the airplane's fuselage, the sliding plate 15 partially serving as a section of the fuselage and partially as the tail of the airplane, and the pivoting plates 17*a* and 17*b* serving as the wings of the plane. In this arrangement the sliding plate 15 is in a fully extended position and the pivoting wing plates 17*a* and 17*b* in a fully spread position.

Figure 4:
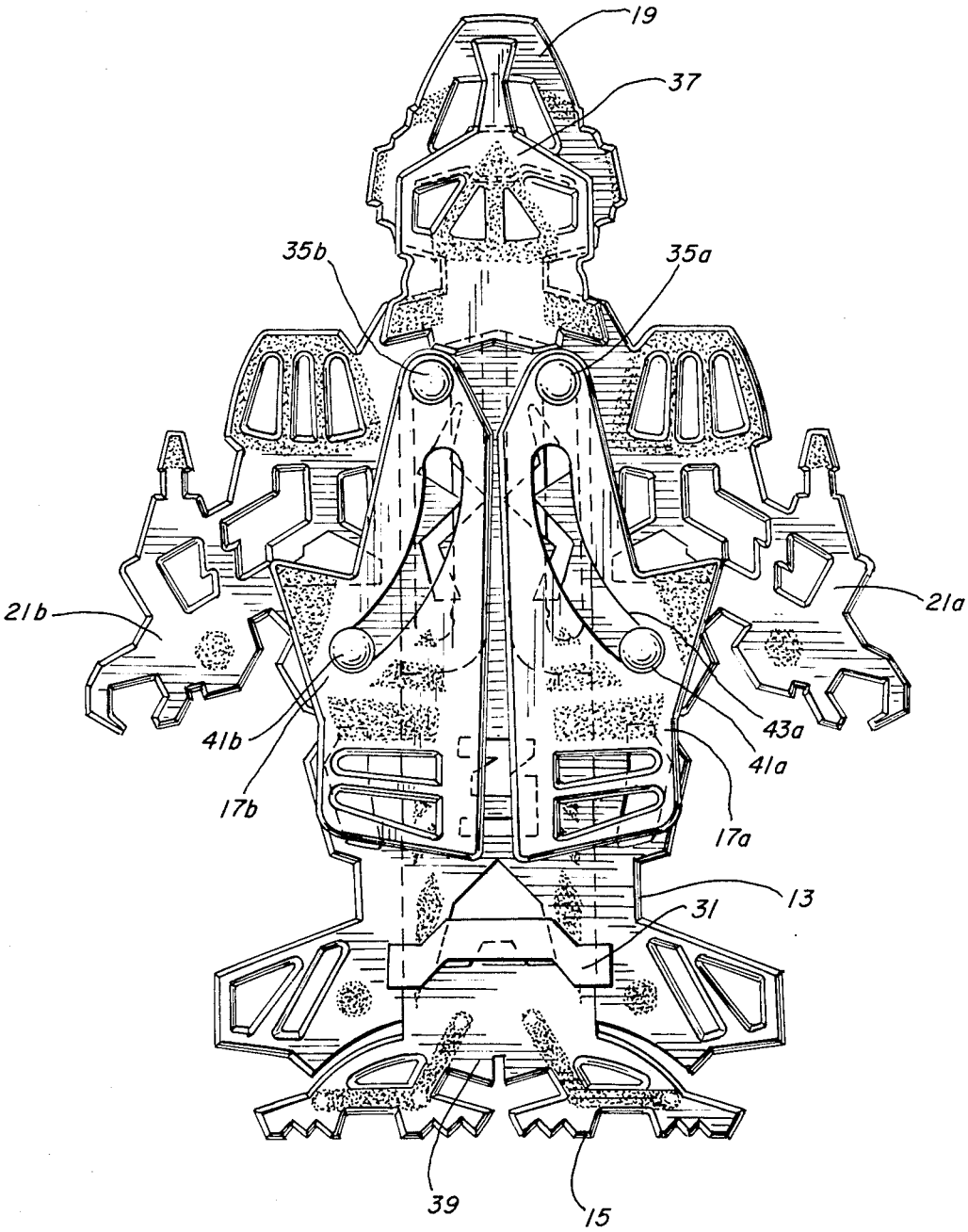
FIG. 4 is a plan view of the first embodiment showing the stencil toy in a retracted position in which it appears as a robot.

By moving the sliding plate 15 forward and into the body plate 13, the user can place the stencil toy into the second configuration which appears in FIG. 4. This second configuration or identity is that of a robot. In this arrangement the sliding plate 15 is in a fully retracted position, and it overlaps and combines with the body plate 13 to form the body of the robot. The two pivoting wing plates 17*a* and 17*b* are also in a fully retracted position, serving as chest guards for the robot.

Figure 1:
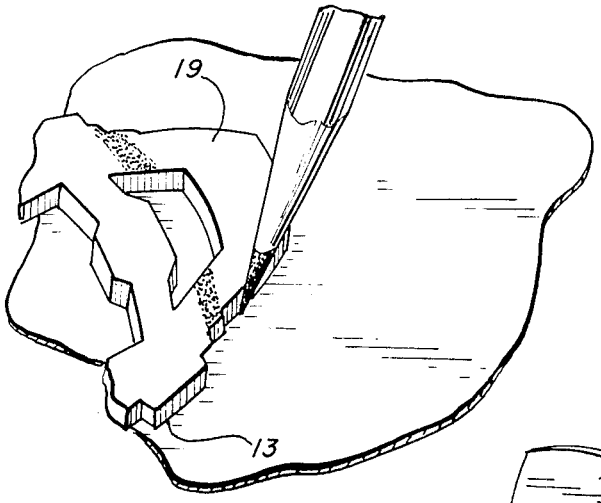
FIG. 1 is a partial perspective view of the embodiment of the transformable stencil toy shown in FIGS. 2–4 with the user of the toy tracing its outline on a surface.
Figure 2:
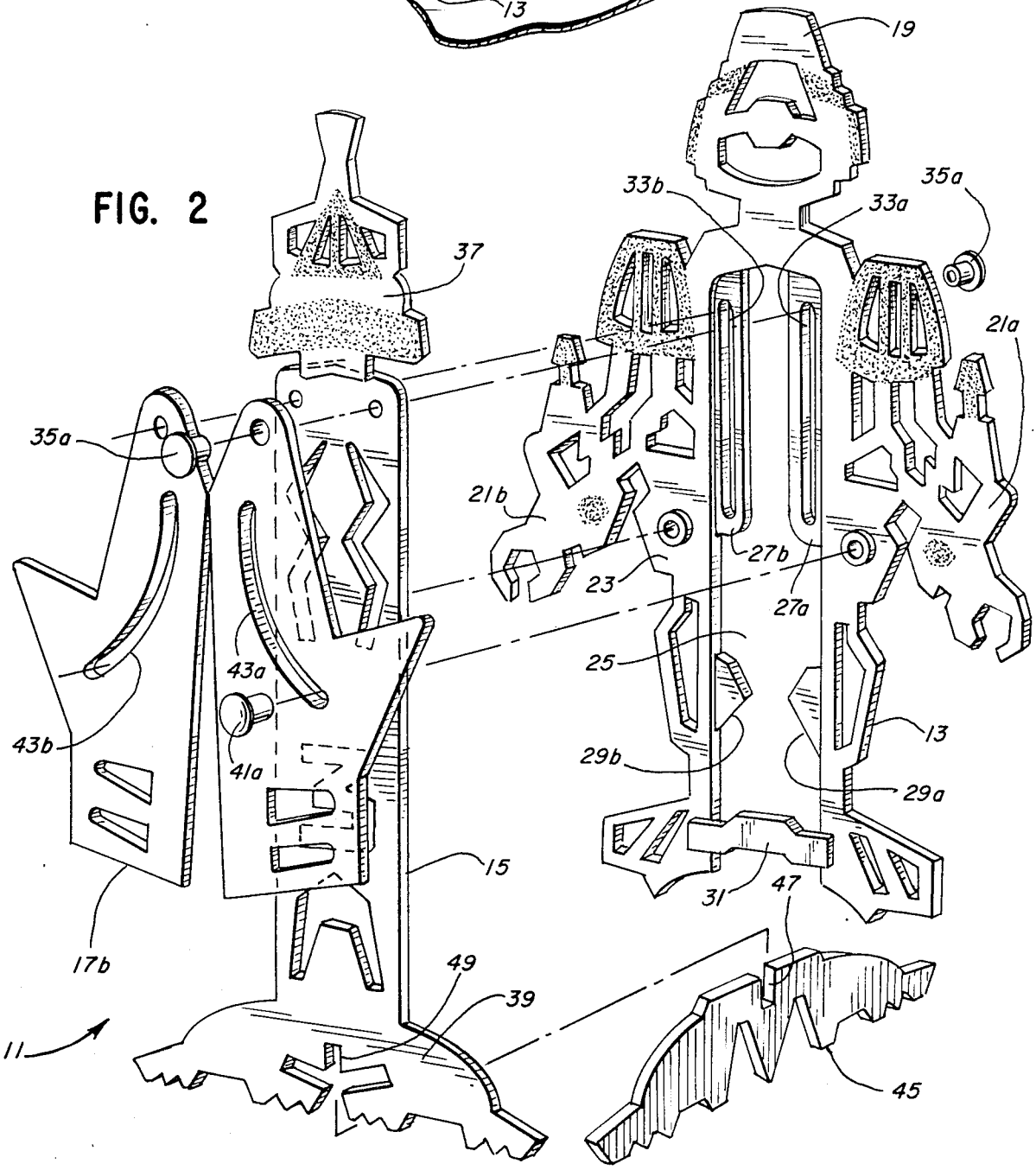
FIG. 2 is an exploded perspective view of the first embodiment of the transformable stencil toy.

Referring to FIG. 2, the body plate 13 supports the other plates, defines a sliding path for the sliding plate 15, and includes a head portion 19, arm portions 21*a* and 21*b* and a body portion 23. The body portion 23 has a generally rectangular and elongate opening 25 that extends through its center and serves as a guide channel for the sliding plate 15. The body plate 13 also includes elongate guide members 27*a* and 27*b* disposed within opening 25, at the top and on opposite sides of the opening, and slightly recessed from the top surface of the body portion 23; guide members 29*a* and 29*b* disposed within opening 25 at the center and on opposite sides of the opening, and slightly recessed from the top surface of the body portion 23; and guide member 31 disposed over the opening 25 at the bottom of the opening (See FIG. 10). These guide members support the sliding plate 15 as it moves up and down the opening 25. To limit the path of slidable engagement of the sliding member 15 between two well defined points that represent the two plate arrangements forming the two configurations discussed above, the guide members 27*a* and 27*b* each have an elongate slot 33*a* and 33*b*, respectively. The slot 33*a* coacts with a pin or rivet 35*a* fixed to the slidable plate 15 and the slot 33*b* coacts with a rivet 35*b* also fixed to the slidable plate 15 to perform this function.

Rivets 35*a* and 35*b* connect plate 15 to plate 13 by engaging the sides of slots 33*a* and 33*b*, respectively, (See FIG. 10A) and they allow sliding movement between the two plates as they move along slot 33*a* and 33*b*. When the stencil toy assumes the airplane configuration of FIG. 3, the top distal ends of the slots 33*a* and 33*b* stop the corresponding rivets 35*a* and 35*b* and the bottom distal ends stop the rivets when the stencil toy assumes the robot configuration of FIG. 4.

The sliding plate 15 is an elongate member whose top end 37 serves as a head guard in one mode and as the front end of an airplane in the other and whose bottom end 39 serves as feet in one mode and as the tail of an airplane in the other. The top end 37 is offset from the plane of the main portion of the sliding plate 15 so as not to impede the movement of plate 15 in the opening 25.

Rivets 35*a* and 35*b*, in addition to connecting plate 15 with plate 13, pivotally connect pivoting wing plates 17*a* and 17*b* to plate 15 through appropriately sized bores in those plates. Another pair of rivets, 41*a* and 41*b*, which are fixed to plate 13, engage the sides of and coact with corresponding arcuate openings, 43*a* and 43*b*, respectively, (See FIG. 10A) in wing plates 17*a* and 17*b*, respectively, to define the path of travel of the wing plates as they pivot around rivets 35*a* and 35*b*. When the stencil toy assumes the airplane configuration of FIG. 3 the rivets 41*a* and 41*b* move to the upper distal ends of corresponding openings 43*a* and 43*b* close to the rivets 35*a* and 35*b*; but when it assumes the robot configuration of FIG. 4 they move to the opposite distal ends. The wing plates 17*a* and 17*b* are similar in shape and they move in similar paths to give this construction geometric symmetry.

Figure 9:
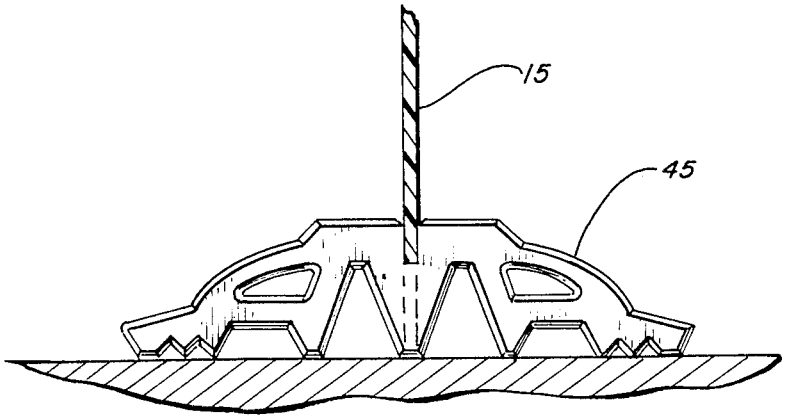
FIG. 9 is an elevation view of a stand plate used to mount the manipulatable stencil of the present invention in an upright position.
Figure 10:
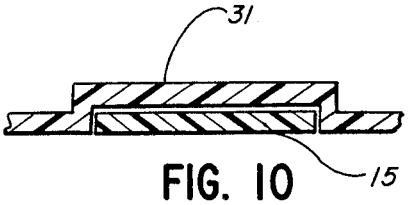
FIG. 10 is a sectional view taken along line 10—10 in FIG. 3.
Figure 10A:
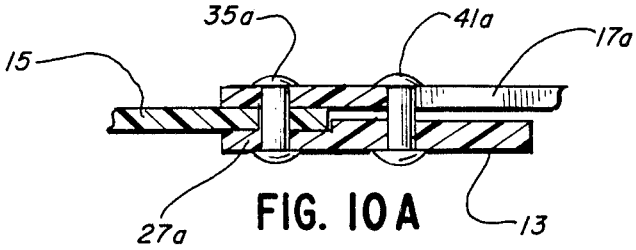
FIG. 10A is a sectional view taken along line 10—10A in FIG. 3.

FIGS. 2 and 9 illustrate an additional feature of the present invention which may form a part of this construction and the constructions of subsequent embodiments of the present invention discussed below. The user of the stencil toy may use a mounting plate 45 to stand the toy in an upright position by placing the plate 45 perpendicular to the sliding plate 15 and coupling the two plates together with a groove 47 in the plate 45 and a groove 49 in the sliding plate 15. The groove 47 receives plate 15 and the groove 49 receives the plate 45.

Figure 5:
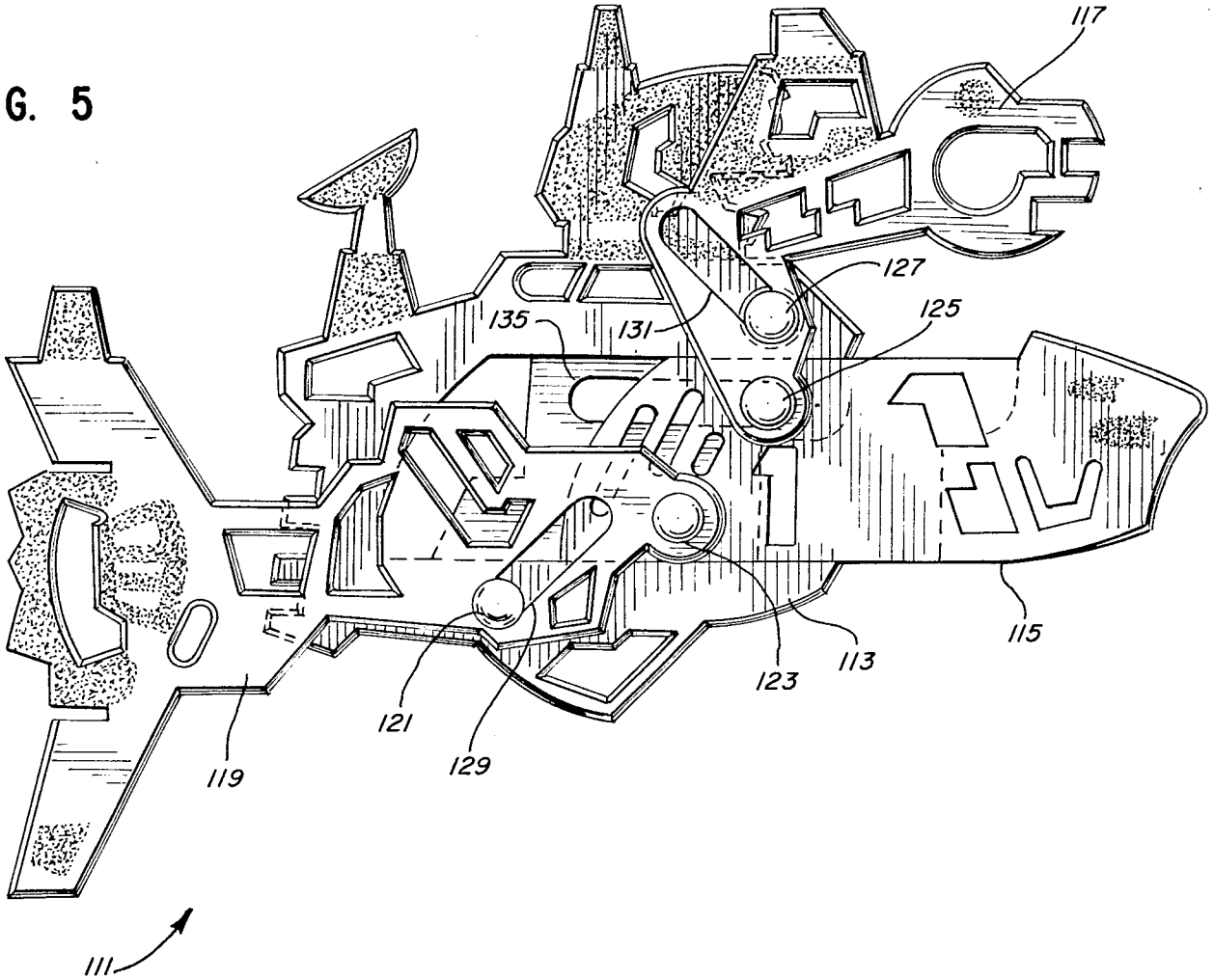
FIG. 5 is a plan view of a second embodiment of the present invention showing the stencil toy in an extended position in which it appears as a submarine.
Figure 6:
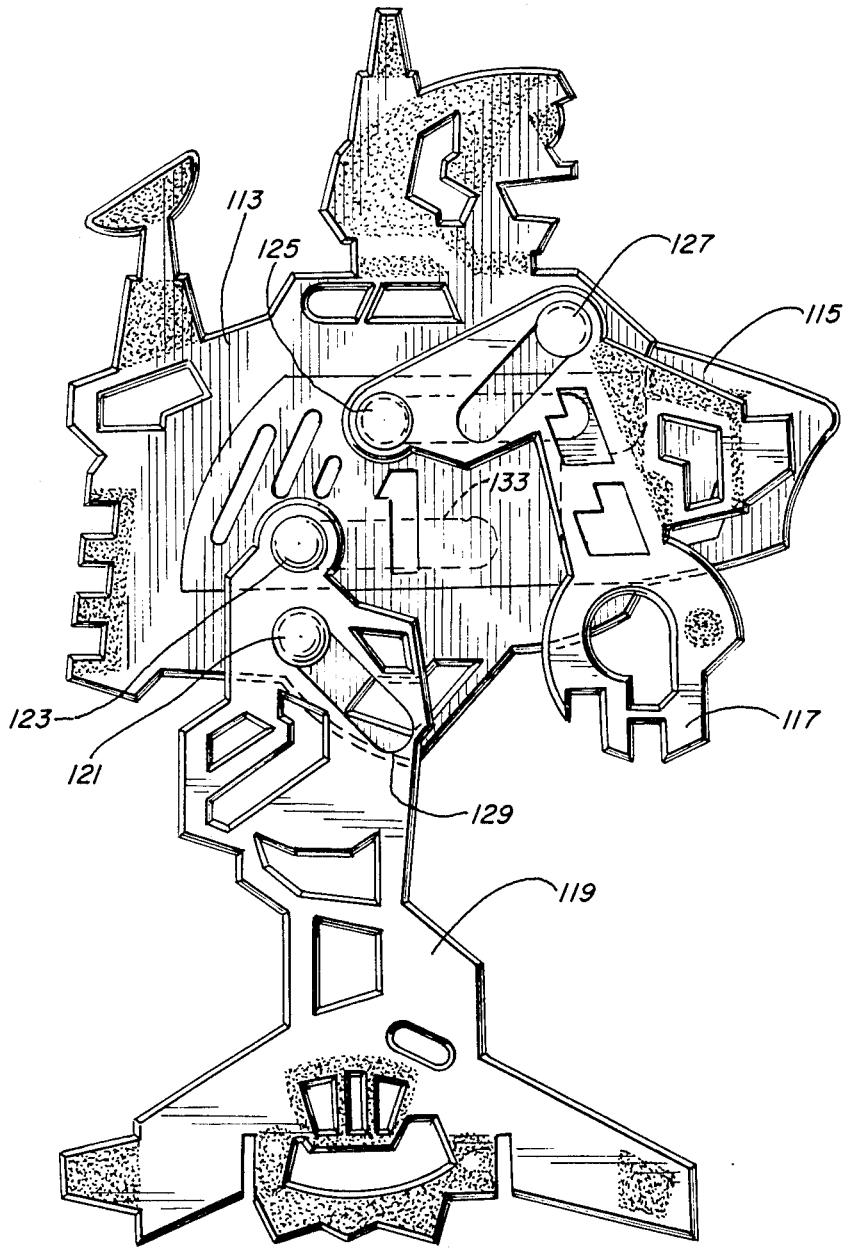
FIG. 6 is a plan view of the second embodiment showing the stencil toy in a retracted position in which it appears as a robot unlike the robot of the first embodiment shown in FIG. 2.

FIGS. 5 and 6 illustrate a second embodiment of the transformable stencil toy of the present invention at 111. This stencil toy is also a four plate construction, and generally, it comprises a body plate 113, a sliding plate 115, and two pivoting plates 117 and 119. This four plate construction, however, does not have the geometric symmetry of the previous embodiment as evidenced by the marked difference between the shapes of the two pivoting plates and by the different paths that they follow when pivoting.

Together, the four plates of this construction also form a two dimensional, transformational toy which a user can transform from one configuration to another completely different configuration in one smooth, fluid motion.

The first configuration of the second embodiment is generally that of a submarine as shown in FIG. 5 with the body plate 113 serving as the mid-section of the submarine, including the periscope, the sliding plate 115 as the front of the submarine, the pivoting plate 117 as a deck gun, and the other pivoting plate 119 as the tail. In this configuration the sliding plate 115 is in a fully extended position.

By moving the sliding plate 115 to the left into the body plate 113 the user can place the stencil toy into the second configuration as shown in FIG. 6. This second configuration is that of a robot, unlike the robot of the first embodiment shown in FIG. 4. Here, the body plate 113 and the sliding plate 115 serve as the body of the robot, the pivoting plate 117 serves as an arm, and the other pivoting plate 119 serves as the legs of the robot.

Rivets 121, 123, 125, 127 connect the four plates together and facilitate the transformation from one configuration to another. The rivets 121 and 127 are fixed to body plate 113 and they engage the sides of openings 129 and 131 in pivoting plates 119 and 117, respectively, and coact with them to limit and define the travel path of the two pivoting plates. As the pivoting plates 117 and 119 move from one configuration to another, the rivets 121 and 127 move along opening 129 and 131, respectively, and the two distal ends of each opening act in conjunction with the rivet located in the opening to stop the pivoting plate when it has reached the location required for the particular configuration.

The rivets 123 and 125 pivotally connect the pivoting plates 119 and 117, respectively, to the sliding plate 115 and they slidingly connect the sliding plate 115 to the body plate by engaging the sides of openings 133 and 135, respectively, and moving along these openings as the user moves the sliding plate in or out. When the stencil toy assumes the submarine configuration of FIG. 5, the rivets 123 and 125 move to the distal ends of the openings 133 and 135, towards the right, and rivets 121 and 127 move to the distal ends of their corresponding openings. The distal ends of these openings stop the corresponding rivets and the plates to which they are fixed to place the toy in the submarine configuration. When it assumes the robot configuration of FIG. 6 the rivets 121, 123, 125 and 127 move to the opposite distal ends of their corresponding openings, and these ends stop the rivets and the plates to which they are fixed.

Figure 7:
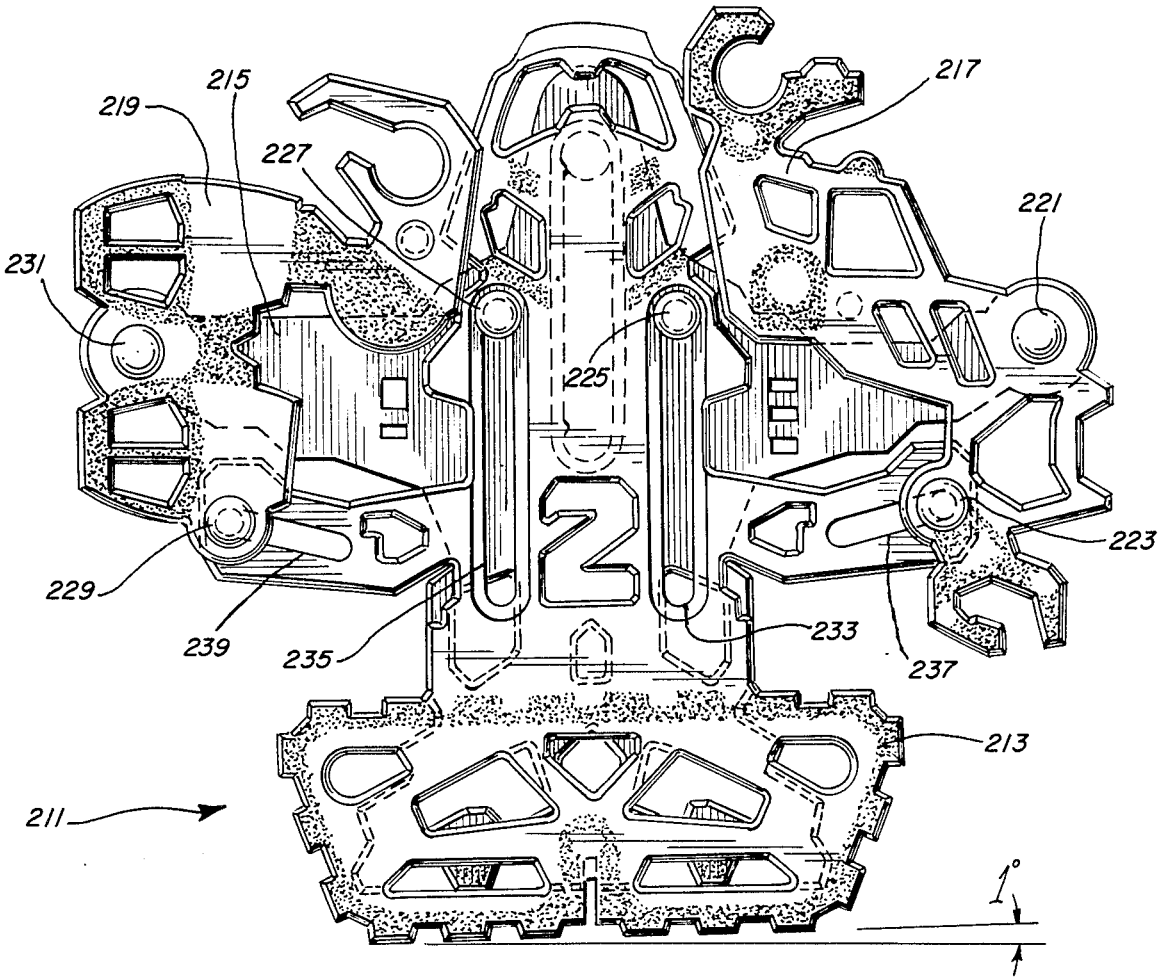
FIG. 7 is a plan view of a third embodiment of the present invention showing the stencil toy in a retracted position in which it appears as an armored vehicle carrying guns and moving on caterpillar treads.
Figure 8:
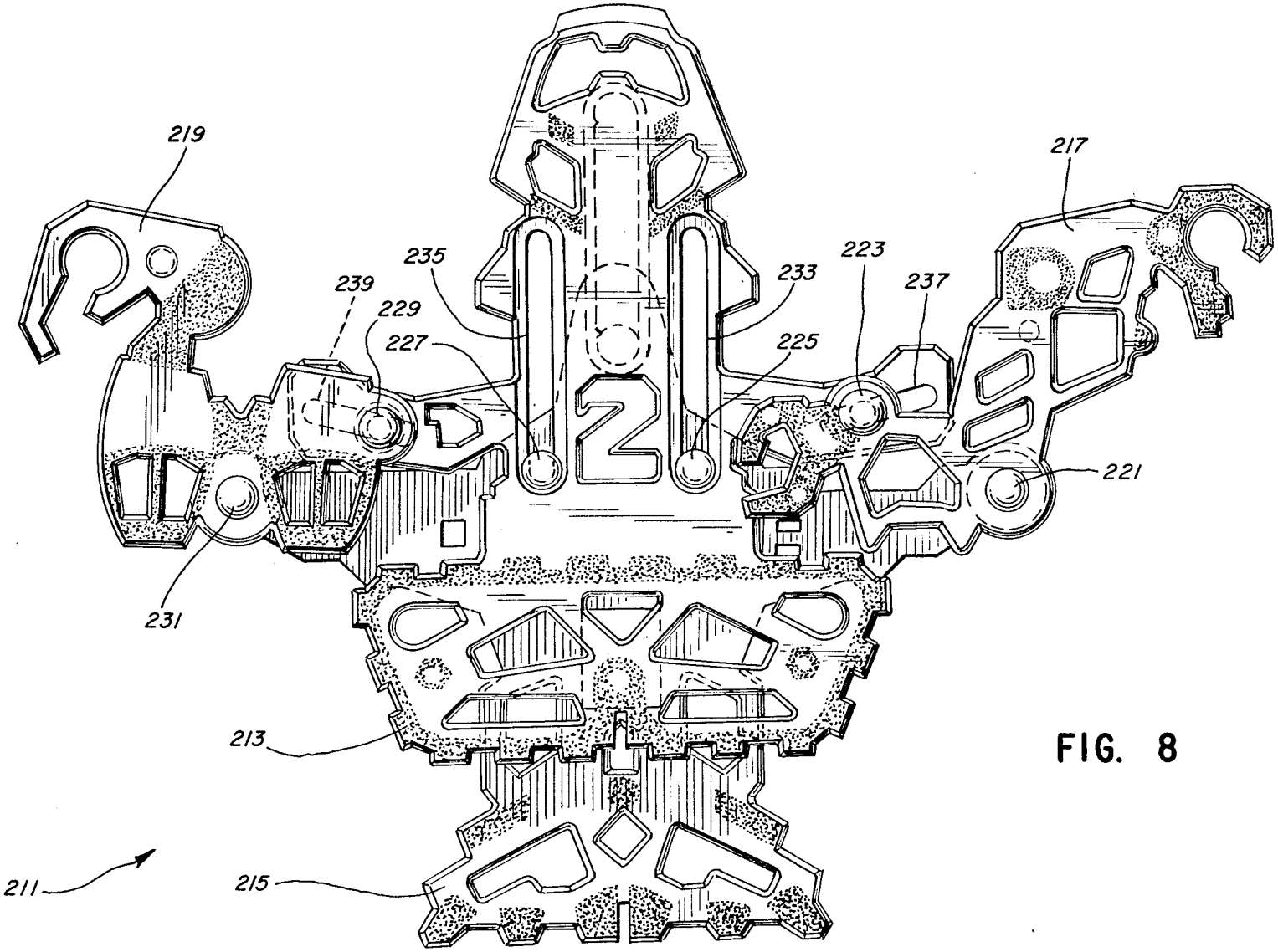
FIG. 8 is a plan view of the third embodiment showing the stencil toy in an extended position in which it appears as a robot unlike the robots of the first two embodiments shown in FIGS. 2 and 4.

FIGS. 7 and 8 illustrate the third embodiment of the transformable stencil toy of the present invention at 211. This stencil toy is also a four plate construction, and generally it comprises a body plate 213, a sliding plate 215, and two pivoting arm plates 217 and 219.

These four plates form a two dimensional, transformational toy, like the toys of the two previous embodiments, which a user can transform from one configuration to another completely different configuration in one smooth, fluid motion.

The first configuration of the third embodiment is generally that of an armored vehicle carrying guns and cannons and moving on caterpillar treads as shown in FIG. 7 with the body plate 213 and the sliding plate 215 serving as the main body of the vehicle. The pivoting arm plates 217 and 219 serve as the guns and cannons. The sliding plate 215 and the pivoting arms 217 and 219 are in a retracted position in this configuration.

By pulling the sliding plate 215 downward into a fully extended position, the user can place the stencil toy into the second configuration as shown in FIG. 8. This second configuration is, again, that of a robot, unlike the robots of the first two embodiments. Here, the body plate 213 and the sliding plate 215 serve as the body of the robot, including the legs, and the pivoting arm plates 217 and 219 serve as the arms of the robot.

This embodiment of the stencil toy uses six rivets, 221, 223, 225, 227, 229 and 231, to connect the four plates together and facilitate the transformation from one configuration to another. The rivets 225 and 227 are fixed to the sliding plate 215, and they slidingly connect the sliding plate 215 to the body plate 213 using two vertical elongate slots 233 and 235 in the body plate 213; the rivets 221 and 231 pivotally connect the pivoting arm plates 217 and 219, respectively, to the sliding plate 215; and the rivets 223 and 229 are fixed to the pivoting arm plates 217 and 219, respectively, and they slidingly engage the body plate 213 using two slots 237 and 239, respectively, in the body plate 213.

When the stencil toy assumes the armored vehicle configuration of FIG. 7, each of the rivets 225, 227, 223 and 229 moves to and stops at one distal end of the slot with which it coacts; and when it assumes the second configuration each of the rivets moves to the slot's opposite distal end which stops the rivet.

While only three embodiments of the invention have been shown, it will be understood, of course, that the invention is not limited thereto since modifications may be made and other embodiments of the principles of this invention will occur to those skilled in the art to which the invention pertains, particularly upon considering the foregoing teachings. For example, those skilled in the art will appreciate that one may use only one pivoting plate in these stencil toys. One may also use more than two pivoting plates. Additionally, one skilled in the art will appreciate that he or she can use a wide variety of peripheral shapes and perforation patterns for the plates used in the stencil construction and a wide variety of rivet and guiding slot arrangements so that the stencil toy may assume more that two configurations. It is therefore, contemplated by the appended claims to cover any such modification and other embodiments as incorporate those features which constitute the essential features of this invention within the true spirit and scope of the following claims:

What is claimed is:

1. A transformable stencil toy comprising: a main body portion; a sliding body portion in slidable engagement with said main body portion, said slidable engagement having at least two defined limits; at least one pivoting body portion, said pivoting body portion in pivotal engagement with said sliding body portion and in limited slidable engagement with said main body portion, such that when said sliding body portion is at the first limit of its slidable engagement with said main body portion said pivoting body portion is in a first predetermined position such that said stencil toy is in the configuration of a first traceable object, and when said sliding body portion is at the second limit of its slidable engagement with said main body portion, said pivoting body portion is at a second predetermined position such that said stencil toy is transformed into the configuration of a second traceable object.

2. The transformable stencil toy of claim 1 wherein the slidable engagement between the main body portion and the sliding body portion is provided by at least one elongate opening in said main body portion, the ends of said opening defining the limits of said sliding engagement, and a first pin member fixedly mounted in said sliding body portion and engaging said elongate opening such that as said pin member is moved along said opening, said sliding body portion is caused to slide with respect to said main body portion.

3. The transformable stencil toy of claim 2 wherein said pivoting body portion is provided with a bore through which said first pin member engages said pivoting body portion, thereby providing pivotal engagement of said pivoting body portion with respect to said sliding body portion.

4. The transformable stencil toy of claim 3 wherein said pivoting body portion is further provided with an elongate opening therein having two ends and said main body portion is provided with a second pin member which engages said opening in said pivoting body portion to provide slidable engagement of said pivoting body portion to said main body portion, the ends of said opening in said pivoting body portion determining the limits of said slidable engagement.

5. The transformable stencil toy of claim 3 wherein said main body portion is further provided with a second opening therein having two ends and said pivoting body portion is provided with a second pin member which engages said second opening to provide slidable engagement of said pivoting body portion to said main body portion, the ends of said second opening determining the limits of said slidable engagement.

6. The transformable stencil toy of claim 1 further comprising a stand means for maintaining said toy in a vertical position.

7. The transformable stencil toy of claim 1, wherein said main body portion, said sliding body portion, and said pivoting body portion are perforated.

8. The transformable stencil toy of claim 7, wherein said main, sliding, and pivoting body portions are made of a plastic material.

9. The transformable stencil toy of claim 1, wherein said first traceable object is an armament and said second traceable object is a robot.

10. A transformable stencil toy comprising: a flat, perforated main body portion; a flat, perforated sliding body portion in slidable engagement with said main body portion, said slidable engagement having at least two defined limits and said slidable engagement provided by at least one elongate opening in said main body portion, the ends of said opening defining the limits of said sliding engagement, and a first pin member fixedly mounted in said sliding body portion and engaging said elongate opening such that as said pin member is moved along said opening, said sliding body portion is caused to slide with respect to said main body portion; at least one flat, perforated pivoting body portion, said pivoting body portion in pivotal engagement with said sliding body portion and in limited slidable engagement with said main body portion, such that when said sliding body portion is at the first limit of its slidable engagement with said main body portion said pivoting body portion is in a first predetermined position such that said stencil toy is in the configuration of a first traceable object, and when said sliding body portion is at a second limit of its slidable engagement with said main body portion, said pivoting body portion is at a second predetermined position such said stencil toy is transformed into the configuration of a second traceable object, said pivoting body portion is provided with an bore through which said first pin member engages said pivoting body portion, thereby providing pivotal engagement of said pivoting body portion with respect to said sliding body portion and with an elongate opening therein having two ends and said main body portion is provided with a second pin member which engages said opening in said pivoting body portion to provide slidable engagement of said pivoting body portion to said main body portion, the ends of said opening in said pivoting body portion determining the limits of said slidable engagement between said pivoting body portion and said main body portion.

11. A transformable stencil toy comprising: a flat, perforated main body portion; a flat, perforated sliding body portion in slidable engagement with said main body portion, slidable engagement having at least two defined limit and said slidable engagement provided by at least one elongate opening in said main body portion, the ends of said opening defining the limits of said sliding engagement, and a first pin member fixedly mounted in said sliding body portion and engaging said elongate opening such that as said pin member is moved along said opening, said sliding body portion is caused to slide with respect to said main body portion; at least one flat, perforated pivoting body portion, said pivoting body portion in pivotal engagement with said sliding body portion and in limited slidable engagement with said main body portion, such that when said sliding body portion is at the first limit of its slidable engagement with said main body portion said pivoting body portion is in a first predetermined position such that said stencil toy is in the configuration of a first traceable object, and when said sliding body portion is at a second limit of its slidable engagement with said main body portion, said pivoting body portion is at a second predetermined position such that said stencil toy is transformed into the configuration of a second traceable object, said pivoting body portion is provided with an bore through which said first pin member engages said pivoting body portion, thereby providing pivotal engagement of said pivoting body portion with respect to said sliding body portion; said main body portion is provided with a second opening therein having two ends and said pivoting body portion is provided with a second pin member which engages said second opening to provide slidable engagement of said pivoting body portion to said main body portion, the ends of said second opening determining the limits of said slidable engagement between said pivoting body portion and said main body portion.

12. The transformable stencil toy of claim 10 or 11, wherein said first traceable object is an armament and said second traceable object is a robot.

* * * * *